US007607179B2

(12) United States Patent
Shih

(10) Patent No.: US 7,607,179 B2
(45) Date of Patent: Oct. 27, 2009

(54) SHOCK-ABSORBING HELMET

(75) Inventor: Jung-Tso Shih, Taipei Hsien (TW)

(73) Assignee: Yu Hsun Enterprise Co., Ltd., Taipei (TW)

( * ) Notice: Subject to any disclaimer, the term of this patent is extended or adjusted under 35 U.S.C. 154(b) by 657 days.

(21) Appl. No.: 11/325,452

(22) Filed: Jan. 5, 2006

(65) Prior Publication Data

US 2007/0151003 A1 Jul. 5, 2007

(51) Int. Cl.
*A42B 3/00* (2006.01)

(52) U.S. Cl. ..... 2/411; 2/424

(58) Field of Classification Search ..... 2/424–425, 2/410–414, 9–10, 463
See application file for complete search history.

(56) References Cited

U.S. PATENT DOCUMENTS 3,365,725 A * 1/1968 Webb ..... 2/413
3,946,441 A * 3/1976 Johnson ..... 2/412
5,371,905 A * 12/1994 Keim ..... 2/413
5,724,681 A * 3/1998 Sykes ..... 2/425
5,956,777 A * 9/1999 Popovich ..... 2/424
6,154,889 A * 12/2000 Moore et al. ..... 2/418
6,481,026 B1 * 11/2002 McIntosh ..... 2/468
7,036,151 B2 * 5/2006 Ide et al. ..... 2/9

* cited by examiner

*Primary Examiner*—Shaun R Hurley
*Assistant Examiner*—Andrew W Sutton
(74) *Attorney, Agent, or Firm*—Birch, Stewart, Kolasch & Birch, LLP

(57) ABSTRACT

A shock-absorbing helmet is disclosed to include a helmet body, which has a receiving space for receiving the user's head and a front open side, a facemask provided at the front open side of the helmet body, and a plurality shock absorbers affixed to the helmet body and respectively coupled to the facemask to absorb shocks upon an impact at the facemask.

5 Claims, 5 Drawing Sheets

SHOCK-ABSORBING HELMET

BACKGROUND OF THE INVENTION

1. Field of the Invention

The present invention relates to a protective equipment for sports and more specifically, to a shock-absorbing helmet, which has a plurality of shock absorbers coupled between the helmet body and the facemask to absorb shocks upon an impact at the facemask.

2. Description of the Related Art

A protective equipment for sports is known comprising a helmet and a facemask. The helmet has a receiving space for receiving the user's head, and a front open side. The facemask is provided at the front open side of the helmet to protect the user's face against impact. However, because the facemask is directly fastened to the helmet, shocks are directly transmitted from the facemask to the helmet and the user's head or face upon an impact. Therefore, this conventional design is still not satisfactory in function.

SUMMARY OF THE INVENTION

The present invention has been accomplished under the circumstances in view. It is the main object of the present invention to provide a shock-absorbing helmet, which has shock absorbers coupled between the helmet body and the facemask to absorb shocks upon an impact. It is another object of the present invention to provide a shock-absorbing helmet, which uses hollow holder frames to hold shock absorbers at the helmet body and locating devices to couple shock absorbers to the facemask, enabling the shock absorbers to absorb shocks from the facemask.

To achieve these and other objects of the present invention, the shock-absorbing helmet comprises a helmet body, which has a receiving space for receiving the user's head and a front open side, a plurality of hollow holder frames respectively affixed to the helmet body around the front open side, a facemask provided at the front open side of the helmet body, a plurality of locating devices respectively fastened to the facemask corresponding to the hollow holder frames, and a plurality shock absorbers mounted in the hollow holder frames at the helmet body and respectively coupled to the locating devices at the facemask to absorb shocks upon an impact at the facemask.

DETAILED DESCRIPTION OF THE PREFERRED EMBODIMENT

Figure 1:
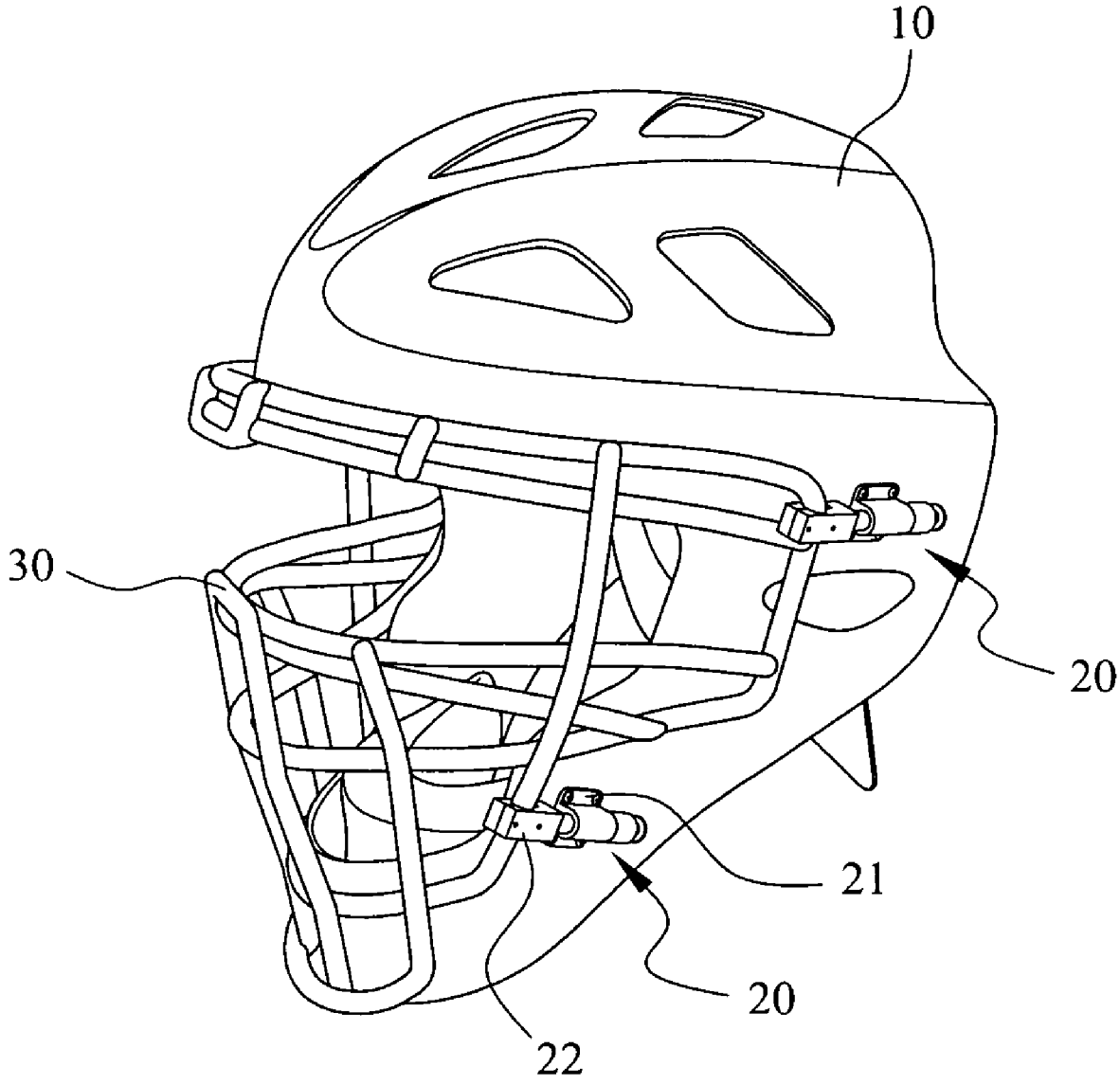
FIG. 1 is a perspective view of a shock-absorbing helmet according to the present invention.
Figure 2:
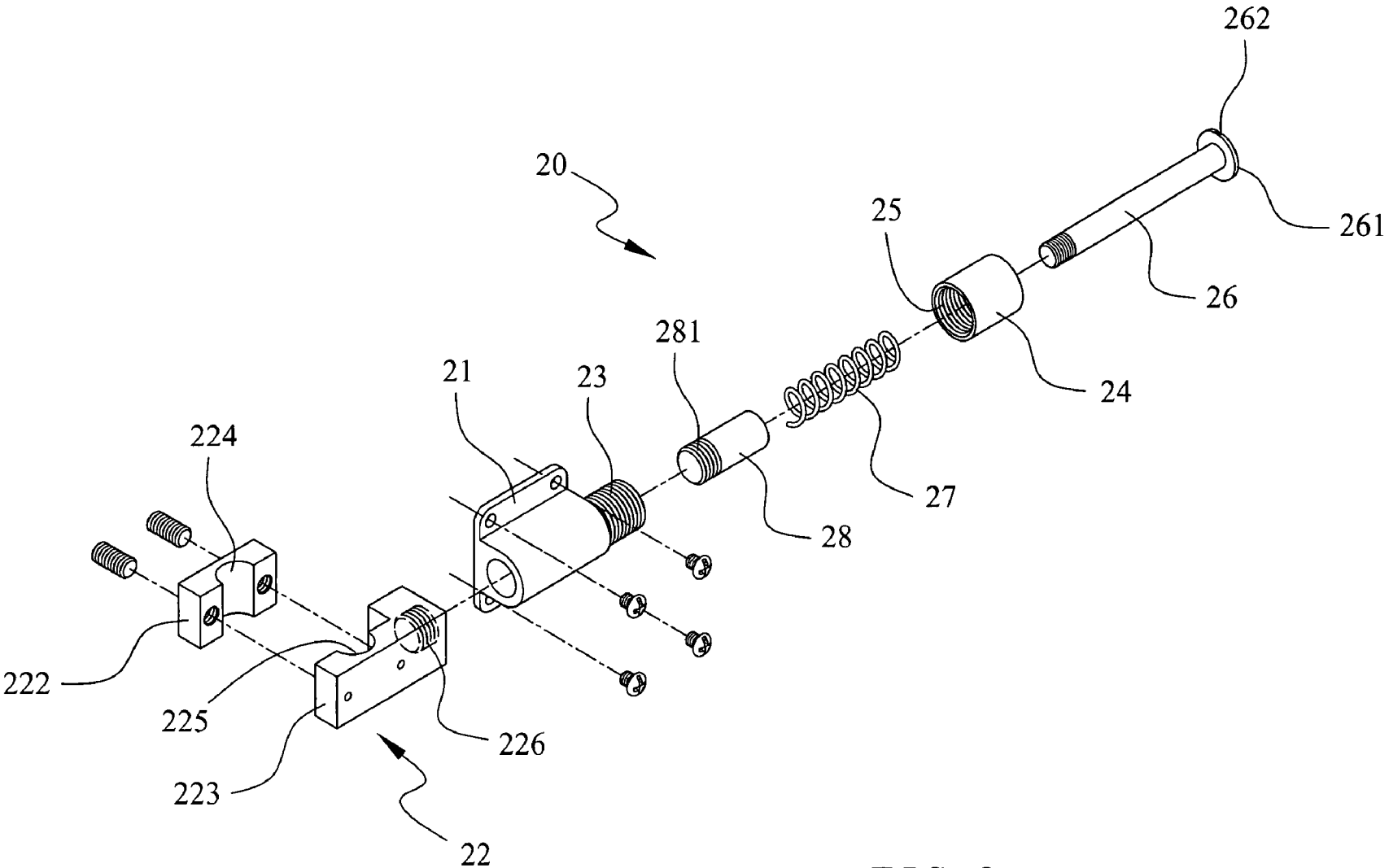
FIG. 2 is an exploded view of a shock-absorber for use in a shock-absorbing helmet according to the present invention
Figure 3:
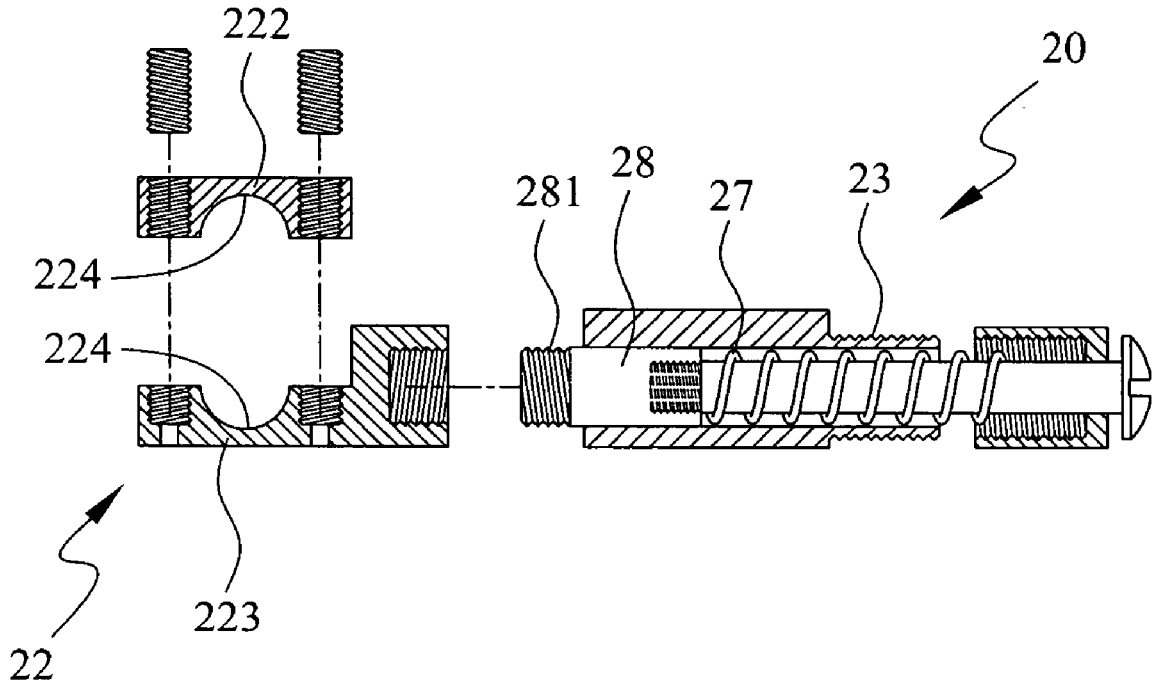
FIG. 3 is a schematic sectional view of the shock-absorber according to the present invention.

Referring to FIGS. 1~3, a shock-absorbing helmet in accordance with the present invention is shown comprising a helmet body 10, a plurality of shock absorbers 20, and a facemask 30. The helmet body 10 defines therein a holding space for receiving the user's head, having a front open side. The shock absorbers 20 can be spring type, hydraulic type, pneumatic type shock absorbers, and made out of metallic or non-metallic material such as aluminum alloy, plastics, etc. The shock absorbers 20 are affixed to the helmet body 10. Each shock absorber 20 comprises a hollow holder frame 21 fixedly fastened to the helmet body 10, and is connected to a locating device 22 at the facemask 30 through a front outer thread 281 thereof. The locating device 22 comprises a top clamp 222 and a bottom clamp 223. The top clamp 222 has a clamping groove 224. The bottom clamp 223 has a clamping groove 225, and a fastening means 226. According to this embodiment, the fastening means 226 is a female screw. Further, the locating device 22 can be formed of a U-clamp.

The facemask 30 is provided at the front open side of the helmet body 10 and coupled to the shock absorbers 20.

In a spring type, the shock absorber 20 comprises a sleeve 28 inserted through the hollow holder frame 21 and having the aforesaid outer thread 281 formed on the front end thereof and threaded into the inner thread 226 of the locating device 22 at the facemask 30, an adjustment cap 24, which has an inner thread 25 threaded onto an outer thread 23 are the rear side of the hollow holder frame 21, a rod member 26 inserted through the adjustment cap 24 into the sleeve 28, and a spring member 27 sleeved onto the bolt 26 inside the adjustment cap 24 and stopped between one end of the sleeve 28 and a part inside the adjustment cap 24. The rod member 26 has a head 261 disposed outside the adjustment cap 24 and a groove 262 at the head 261 for the positioning of one end of the spring member 27.

Figure 4:
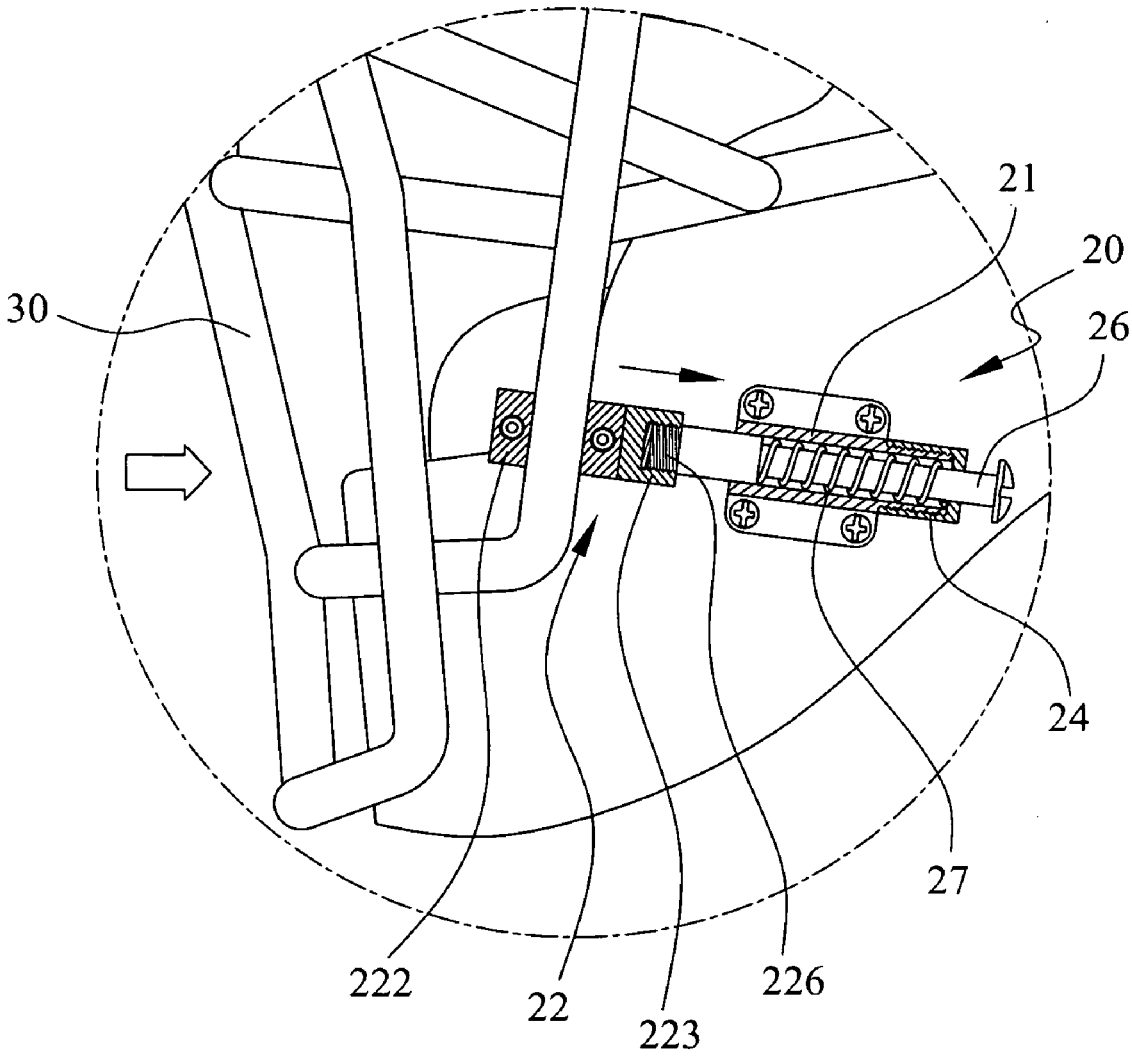
FIG. 4 is a schematic sectional view of a part of the shock-absorbing helmet according to the present invention, showing the shock-absorber in action.

Referring to FIG. 4 and FIG. 1 again, the shock absorbers 20 are respectively coupled between the helmet body 10 and the facemask 30 to absorb shocks upon an impact at the facemask 30. By means of the respective locating devices 22 at the facemask 30 and the respective hollow holder frames 21 at the helmet body 10, the shock absorbers 20 are positively coupled between the helmet body 10 and the facemask 30. Further, the user can rotate the adjustment cap 24 forwards/backwards along the outer thread 23 at the hollow holder frame 23 to adjust the spring power of the spring member 27.

Figure 5:
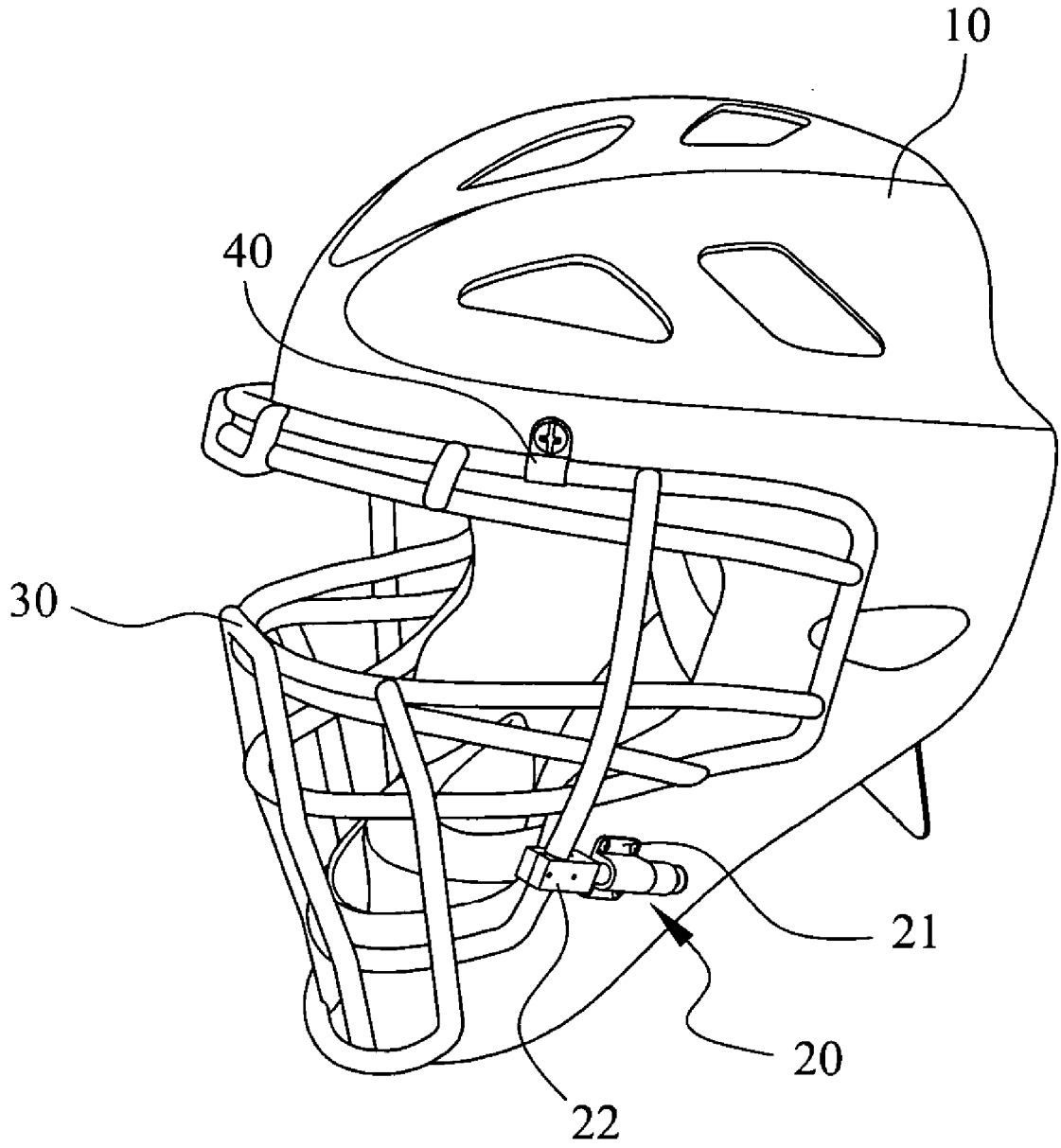
FIG. 5 is a perspective view of an alternate form of the shock-absorbing helmet according to the present invention.

Referring to FIG. 5, in addition to the connection of the shock absorbers 20 between the respective locating devices 22 at the facemask 30 and the respective hollow holder frames 21 at the helmet body 10, swivel fasteners 40 may be coupled to the facemask 40 at the top side and respectively affixed to the helmet body 10.

A prototype of shock-absorbing helmet has been constructed with the features of FIGS. 1~5. The shock-absorbing helmet functions smoothly to provide all of the features discussed earlier.

Although particular embodiments of the invention have been described in detail for purposes of illustration, various modifications and enhancements may be made without departing from the spirit and scope of the invention.

What the invention claimed is:

1. A shock-absorbing helmet comprising:

a helmet body, said helmet body having a receiving space for receiving the user's head and a front open side;

a facemask provided at the front open side of said helmet body; and a plurality of shock absorbers affixed to said helmet body and respectively coupled to said facemask to absorb shocks upon an impact at said facemask, said shock absorbers being spring type shock absorbers that use spring means to absorb shocks, wherein said facemask has a plurality of locating devices adapted to receive said shock absorbers and each of said shock absorbers comprises a hollow holder frame respectively affixed to said helmet body and a sleeve inserted through the respective hollow holder frame, said sleeve having a front outer thread threaded into an inner thread at each of said locating devices, an adjustment cap threaded onto an outer thread at a rear side of the associating hollow holder frame, a rod member inserted through said adjustment cap and said sleeve, said rod member having a head disposed outside said adjustment cap, and a spring member sleeved onto said rod member inside said adjustment cap and affixed to said rod member and stopped between one end of said sleeve and a part of said adjustment cap.

2. The shock-absorbing helmet as claimed in claim 1, wherein said locating devices are U-clamps respectively clamped on said facemask, each having coupling means for receiving said shock absorbers.

3. The shock-absorbing helmet as claimed in claim 1, wherein said locating devices each comprise a top clamp and a bottom clamp, said top clamp having a clamping groove, said bottom clamp having a clamping groove and a fastening means.

4. The shock-absorbing helmet as claimed in claim 3, wherein the fastening means of each of said locating devices is an inner thread; said shock absorbers each have a front outer thread respectively threaded into the inner thread in each of said locating devices.

5. The shock-absorbing helmet as claimed in claim 1, further comprising a plurality of swivel fasteners respectively coupled to said facemask and affixed to said helmet body.

* * * * *